US010566711B2

(12) United States Patent
Huntley

(10) Patent No.: US 10,566,711 B2
(45) **Date of Patent: *Feb. 18, 2020**

(54) FLEXING POKE HOME CONTACT

(71) Applicant: AVX Corporation, Fountain Inn, SC (US)

(72) Inventor: Norman C. Huntley, Bishop's Stortford (GB)

(73) Assignee: AVX CORPORATION, Fountain Inn, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/425,143

(22) Filed: May 29, 2019

(65) Prior Publication Data

US 2019/0280404 A1 Sep. 12, 2019

Related U.S. Application Data

(63) Continuation of application No. 15/967,654, filed on May 1, 2018, now Pat. No. 10,320,096.
(Continued)

(51) Int. Cl.
*H01R 12/00* (2006.01)
*H01R 12/51* (2011.01)
(Continued)

(52) U.S. Cl.
CPC ..... *H01R 12/515* (2013.01); *H01R 12/707* (2013.01); *H01R 12/7076* (2013.01);
(Continued)

(58) Field of Classification Search
CPC .... H01R 12/515; H01R 12/707; H01R 43/26; H01R 13/2442; H01R 12/57; H01R 12/714; H01R 43/205
(Continued)

(56) References Cited

U.S. PATENT DOCUMENTS 1,622,631 A 3/1927 Fahnestock
2,122,252 A 6/1938 Hayes
(Continued)

FOREIGN PATENT DOCUMENTS

CN 1255755 A 6/2000
CN 1967943 A 5/2007
(Continued)

OTHER PUBLICATIONS

Combined Search and Examination Report received for United Kingdom Patent Application No. GB1319036.8 dated Apr. 17, 2014 (6 pages).

(Continued)

*Primary Examiner* — Abdullah A Riyami
*Assistant Examiner* — Nelson R. Burgos-Guntin
(74) *Attorney, Agent, or Firm* — Foley & Lardner LLP

(57) ABSTRACT

An electrical contact for use in connecting electrical wires is disclosed. The electrical contact includes a cage-like structure, a wire connecting portion, and a flexing contact portion. The cage-like structure includes a plurality of sidewalls and is configured to receive a wire. The wire connecting contact portion includes at least two contact tines that are configured to conductively couple with a corresponding wire. The flexing contact portion includes an end wall, an elastic portion, an extension portion, and a nose portion. The flexing contact portion can store elastic energy and apply a force to a corresponding electrical component.

20 Claims, 5 Drawing Sheets

Related U.S. Application Data

(60) Provisional application No. 62/513,655, filed on Jun. 1, 2017.

(51) Int. Cl.

| | |
|---|---|
| ***H01R 12/71*** | (2011.01) |
| ***H01R 43/20*** | (2006.01) |
| ***H01R 43/26*** | (2006.01) |
| ***H01R 12/70*** | (2011.01) |
| *H01R 12/57* | (2011.01) |
| *H01R 13/24* | (2006.01) |
| *H01R 4/48* | (2006.01) |

(52) U.S. Cl.
CPC ..... *H01R 12/714* (2013.01); *H01R 43/205* (2013.01); *H01R 43/26* (2013.01); *H01R 4/4818* (2013.01); *H01R 12/57* (2013.01); *H01R 13/2442* (2013.01)

(58) Field of Classification Search
USPC ..... 439/66, 81, 296, 438, 725, 682, 752.5, 439/856, 857, 853, 858, 862, 869, 873
See application file for complete search history.

(56) References Cited

U.S. PATENT DOCUMENTS 2,603,681 A 7/1952 Salisbury
2,689,337 A 9/1954 Burtt et al.
3,076,953 A 2/1963 Sloop
3,162,501 A 12/1964 Wahl
3,221,293 A 11/1965 Regan
3,363,224 A 1/1968 Gluntz et al.
3,437,983 A 4/1969 Gilissen
3,479,634 A 11/1969 Pritulsky
3,510,831 A 5/1970 De Vito
3,555,497 A 1/1971 Watanabe
3,566,342 A 2/1971 Schmitt et al.
3,601,775 A 8/1971 Longenecker et al.
3,609,640 A 9/1971 Longenecker et al.
3,621,444 A 11/1971 Stein
3,654,583 A 4/1972 Mancini
3,663,931 A 5/1972 Brown
3,673,551 A 6/1972 McDonough
3,678,261 A 7/1972 McNeil
3,711,819 A 1/1973 Matthews
3,718,895 A 2/1973 Reynolds et al.
3,720,907 A 3/1973 Asick
3,778,755 A 12/1973 Marks
3,796,988 A 3/1974 Palombella
3,805,116 A 4/1974 Nehmann
3,818,423 A 6/1974 McDonough
3,824,557 A 7/1974 Mallon
3,846,735 A 11/1974 Carter et al.
3,850,500 A 11/1974 Cobaugh et al.
3,853,389 A 12/1974 Occhipinti
3,867,008 A 2/1975 Gartland, Jr.
3,907,392 A 9/1975 Haag et al.
3,915,537 A 10/1975 Harris et al.
3,915,544 A 10/1975 Yurtin
3,937,553 A 2/1976 Maximoff et al.
3,945,710 A 3/1976 Gartland, Jr.
3,950,065 A 4/1976 Renn
3,955,869 A 5/1976 Licht
3,963,302 A 6/1976 Gourley
3,963,316 A 6/1976 Williams
3,989,331 A 11/1976 Hanlon
3,992,076 A 11/1976 Gluntz
4,012,107 A 3/1977 Cobaugh et al.
4,076,369 A 2/1978 Ostapovitch
4,083,623 A 4/1978 Lynch
4,084,876 A 4/1978 Dinger
4,152,042 A 5/1979 Ostapovitch
4,193,660 A 3/1980 Jaconette
4,214,801 A 7/1980 Cairns et al.
4,232,931 A 11/1980 Takeuchi et al.
4,262,983 A 4/1981 Bogese, II
4,299,436 A 11/1981 Ackerman
4,317,609 A 3/1982 Lapraik
4,331,376 A 5/1982 Leather
4,359,258 A 11/1982 Palecek et al.
4,379,611 A 4/1983 Foege et al.
4,472,017 A 9/1984 Sian
4,527,857 A 7/1985 Hughes et al.
4,556,274 A 12/1985 Olivera
4,585,295 A 4/1986 Ackerman
4,605,277 A 8/1986 DeFilippis et al.
4,618,205 A 10/1986 Freeman
4,640,561 A 2/1987 George
4,643,510 A 2/1987 Urani
4,657,336 A 4/1987 Johnson et al.
4,708,416 A 11/1987 Awano
4,728,304 A 3/1988 Fischer
4,740,180 A 4/1988 Harwath et al.
4,767,342 A 8/1988 Sato
4,772,234 A 9/1988 Cooper
4,781,602 A 11/1988 Cobaugh
4,784,622 A 11/1988 Senor
4,813,881 A 3/1989 Kirby
4,822,288 A 4/1989 Conley
4,907,990 A 3/1990 Bertho et al.
4,932,891 A 6/1990 Spanke et al.
4,932,906 A 6/1990 Kaley et al.
4,934,967 A 6/1990 Marks et al.
4,952,178 A 8/1990 Beer
4,968,271 A 11/1990 Buscella
5,024,627 A 6/1991 Bennett et al.
5,035,658 A 7/1991 Berg
5,038,467 A 8/1991 Murphy
5,046,972 A 9/1991 Pass
5,049,095 A 9/1991 Gugelmeyer
5,064,379 A 11/1991 Ryll et al.
5,116,238 A 5/1992 Holloman
5,131,853 A 7/1992 Meyer
5,152,702 A 10/1992 Pilny
5,167,544 A 12/1992 Brinkman et al.
5,169,322 A 12/1992 Frantz et al.
5,213,530 A 5/1993 Uratsuji
5,263,883 A 11/1993 Kirayoglu
5,269,712 A 12/1993 Denlinger et al.
5,352,125 A 10/1994 Banakis et al.
5,362,244 A 11/1994 Hanson et al.
5,383,800 A 1/1995 Saka et al.
5,397,254 A 3/1995 Powell
5,399,108 A 3/1995 Lu et al.
5,415,571 A 5/1995 Lutsch
5,458,513 A 10/1995 Matsuoka
5,529,517 A 6/1996 Hopf et al.
5,551,897 A 9/1996 Alwine
5,611,717 A 3/1997 Joly
5,615,944 A 4/1997 Siegfried et al.
5,618,187 A 4/1997 Goto
5,645,458 A 7/1997 Hotea
5,664,972 A 9/1997 Zinn et al.
5,676,570 A 10/1997 Scherer
5,713,767 A 2/1998 Hanson et al.
5,769,672 A 6/1998 Flieger
5,788,539 A 8/1998 Fedder
5,888,096 A 3/1999 Soes et al.
5,890,936 A 4/1999 McDonald et al.
5,941,740 A 8/1999 Neuer et al.
5,941,741 A 8/1999 Dobbelaere et al.
5,975,963 A 11/1999 Higuchi et al.
5,997,366 A 12/1999 Libregts
6,000,974 A 12/1999 Hotea
6,012,944 A 1/2000 Hatakeyama
6,039,584 A 3/2000 Ross
6,039,597 A 3/2000 Getselis et al.
6,050,845 A 4/2000 Smalley et al.
6,051,781 A 4/2000 Bianca et al.
6,056,585 A 5/2000 Hatakeyama et al.
6,080,008 A 6/2000 Frantz
6,089,880 A 7/2000 Miyagawa et al.
6,128,181 A 10/2000 Higami et al.

(56) References Cited

U.S. PATENT DOCUMENTS

| | | | | |
|---|---|---|---|---|
| 6,135,784 | A | 10/2000 | Pei | |
| 6,171,126 | B1 | 1/2001 | Wu et al. | |
| 6,186,840 | B1 | 2/2001 | Geltsch et al. | |
| 6,193,567 | B1 | 2/2001 | Hsieh | |
| 6,210,240 | B1 | 4/2001 | Comerci et al. | |
| 6,254,422 | B1 | 7/2001 | Feye-Hohmann | |
| 6,257,912 | B1 | 7/2001 | Boillot et al. | |
| 6,264,498 | B1 | 7/2001 | Froberg | |
| 6,283,769 | B1 | 9/2001 | Asao et al. | |
| 6,309,236 | B1 | 10/2001 | Ullrich | |
| 6,315,591 | B2 | 11/2001 | Oda et al. | |
| 6,319,076 | B1 | 11/2001 | Gollhofer et al. | |
| 6,371,772 | B1 | 4/2002 | Yoneyama et al. | |
| 6,379,179 | B2 | 4/2002 | Shinohara | |
| 6,383,039 | B1 | 5/2002 | Yoneyama et al. | |
| 6,394,829 | B1 | 5/2002 | Patterson et al. | |
| 6,394,858 | B1 | 5/2002 | Geltsch et al. | |
| 6,439,934 | B1 | 8/2002 | Yu | |
| 6,439,935 | B2 | 8/2002 | Saka et al. | |
| 6,442,036 | B2 | 8/2002 | Komatsu | |
| 6,475,042 | B1 | 11/2002 | Yu | |
| 6,478,635 | B2 | 11/2002 | Charles et al. | |
| 6,511,336 | B1 | 1/2003 | Turek et al. | |
| 6,551,143 | B2 | 4/2003 | Tanaka et al. | |
| 6,561,828 | B2 | 5/2003 | Henrici et al. | |
| 6,652,303 | B2 | 11/2003 | Stockel et al. | |
| 6,776,635 | B2 | 8/2004 | Blanchfield et al. | |
| 6,805,591 | B2 | 10/2004 | Garland et al. | |
| 6,814,598 | B2 | 11/2004 | Hoffmann et al. | |
| 6,827,613 | B2 | 12/2004 | Ferderer | |
| 6,991,498 | B2 | 1/2006 | Wertz et al. | |
| 7,048,597 | B2 | 5/2006 | Chen | |
| 7,175,469 | B1 | 2/2007 | Daily et al. | |
| 7,217,162 | B2 | 5/2007 | Harada et al. | |
| 7,303,421 | B2 | 12/2007 | Liao | |
| 7,306,477 | B1 | 12/2007 | Huang et al. | |
| 7,320,616 | B1 | 1/2008 | Legrady et al. | |
| 7,357,651 | B2 | 4/2008 | Minoura et al. | |
| 7,503,814 | B1 | 3/2009 | Lin | |
| 7,530,837 | B2 | 5/2009 | Nieleck et al. | |
| 7,556,509 | B1 | 7/2009 | Oh et al. | |
| 7,581,965 | B1 | 9/2009 | Upasani et al. | |
| 7,654,874 | B2 | 2/2010 | Ader | |
| 7,704,103 | B1 | 4/2010 | Rhein et al. | |
| 7,731,550 | B2 | 6/2010 | Falchetti | |
| 7,771,217 | B2 | 8/2010 | Bethurum et al. | |
| 7,771,243 | B2 | 8/2010 | Peterson et al. | |
| 7,780,489 | B2 | 8/2010 | Stuklek | |
| 7,806,738 | B2 | 10/2010 | Wu et al. | |
| 7,892,050 | B2 | 2/2011 | Pavlovic et al. | |
| 7,967,648 | B2 | 6/2011 | Byrne | |
| 7,988,506 | B2 | 8/2011 | Peterson et al. | |
| 7,997,915 | B2 | 8/2011 | Pueschner et al. | |
| 8,062,046 | B2 | 11/2011 | Daily et al. | |
| 8,096,814 | B2 | 1/2012 | Schell et al. | |
| 8,113,859 | B2 | 2/2012 | Kim | |
| 8,182,229 | B2 | 5/2012 | Rajarajan et al. | |
| 8,182,299 | B2 | 5/2012 | Schrader | |
| 8,206,182 | B2 | 6/2012 | Kuo et al. | |
| 8,206,184 | B2 | 6/2012 | Kwasny et al. | |
| 8,221,167 | B2 | 7/2012 | Kuo et al. | |
| D668,621 | S | 10/2012 | Gieski | |
| 8,277,240 | B2 | 10/2012 | Urano | |
| 8,328,586 | B2 | 12/2012 | Bies et al. | |
| 8,339,235 | B2 | 12/2012 | Beckert et al. | |
| 8,446,733 | B2 | 5/2013 | Hampo et al. | |
| 8,512,050 | B2 | 8/2013 | McGreevy et al. | |
| RE44,490 | E | 9/2013 | Kirstein et al. | |
| 8,591,271 | B2 | 11/2013 | Bies | |
| 8,721,376 | B1 | 5/2014 | Bishop | |
| 9,391,386 | B2 | 7/2016 | Bishop | |
| 9,484,639 | B1 * | 11/2016 | Chen | H01R 4/4845 |
| 9,570,817 | B1 * | 2/2017 | Wang | H01R 4/4818 |
| 9,768,527 | B2 | 9/2017 | Bishop | |
| 9,774,122 | B2 | 9/2017 | Bishop | |
| 9,780,488 | B2 * | 10/2017 | Fu | H01R 4/4827 |
| 2002/0009908 | A1 | 1/2002 | Liu et al. | |
| 2002/0187670 | A1 | 12/2002 | Cisey | |
| 2003/0211787 | A1 | 11/2003 | Harasawa et al. | |
| 2004/0038597 | A1 | 2/2004 | Norris | |
| 2004/0077231 | A1 | 4/2004 | Harada et al. | |
| 2005/0054244 | A1 | 3/2005 | Werner et al. | |
| 2005/0287878 | A1 | 12/2005 | Urbaniak et al. | |
| 2006/0189174 | A1 | 8/2006 | Fabian et al. | |
| 2006/0292937 | A1 | 12/2006 | Morello et al. | |
| 2007/0149015 | A1 | 6/2007 | Minoura et al. | |
| 2008/0076277 | A1 | 3/2008 | Chen et al. | |
| 2008/0124956 | A1 | 5/2008 | Wu | |
| 2008/0214027 | A1 | 9/2008 | Schell et al. | |
| 2009/0209143 | A1 | 8/2009 | Wu et al. | |
| 2010/0173540 | A1 | 7/2010 | Lee et al. | |
| 2011/0039458 | A1 | 2/2011 | Byrne | |
| 2011/0076901 | A1 | 3/2011 | Glick et al. | |
| 2011/0250775 | A1 * | 10/2011 | Bies | H01R 4/4836 439/296 |
| 2011/0250803 | A1 * | 10/2011 | Bies | H01R 4/4836 439/752.5 |
| 2012/0083141 | A1 | 4/2012 | Molnar et al. | |
| 2012/0108113 | A1 | 5/2012 | Yamaguchi et al. | |
| 2012/0295494 | A1 | 11/2012 | Chen | |
| 2013/0168146 | A1 | 7/2013 | Kim et al. | |
| 2013/0210247 | A1 | 8/2013 | Wang et al. | |
| 2013/0316563 | A1 | 11/2013 | Brandberg et al. | |
| 2014/0120783 | A1 | 5/2014 | Bishop | |
| 2014/0242833 | A1 * | 8/2014 | Mostoller | H01R 4/4836 439/438 |
| 2014/0308855 | A1 * | 10/2014 | Gassauer | H01R 4/4836 439/682 |
| 2015/0229050 | A1 | 8/2015 | Shimoji | |
| 2017/0025770 | A1 * | 1/2017 | Bishop | H01R 4/4836 |

FOREIGN PATENT DOCUMENTS

| | | | |
|---|---|---|---|
| CN | 101911395 | A | 12/2010 |
| DE | 19735835 | A1 | 2/1999 |
| DE | 19838008 | A1 | 3/1999 |
| DE | 19735835 | B4 | 12/2004 |
| DE | 10 2010 014 143 | A1 | 10/2011 |
| DE | 10 2010 014 144 | A1 | 10/2011 |
| DE | 20 2011 104 301 | U1 | 11/2011 |
| DE | 10 2011 015 968 | A1 | 10/2012 |
| DE | 10 2011 079 318 | A1 | 1/2013 |
| DE | 10 2013 111 649 | A1 | 5/2014 |
| DE | 20 2010 018 177 | U1 | 7/2014 |
| EP | 0 829 924 | A2 | 3/1998 |
| EP | 2 410 614 | A1 | 1/2012 |
| EP | 2 597 729 | A1 | 5/2013 |
| GB | 2 298 530 | | 9/1996 |
| GB | 2 510 020 | | 7/2014 |
| JP | S5036089 | U | 4/1975 |
| KR | 1020140106444 | A | 9/2014 |
| WO | WO-2010/146525 | A1 | 12/2010 |
| WO | WO-2011/015968 | | 2/2011 |
| WO | WO-2011/083031 | | 7/2011 |

OTHER PUBLICATIONS

Combined Search and Examination Report received in United Kingdom Application No. GB1410966.4 dated Nov. 18, 2014, 6 pages.

Extended European Search Report dated Feb. 2, 2016, from related application No. 15188199.2.

First Office Action for CN Pat. Appl. No. 201610998926.3 dated Sep. 25, 2018 (15 pages).

First Office Action received in co-pending CN Appl. No. 201510574482.6 dated Nov. 3, 2016, with English translation (18 pages).

International Search Report and Written Opinion in PCT/US2018/031946, dated Aug. 31, 2018 (13 pages).

Non-Final Office Action on U.S. Appl. No. 15/967,654 dated Oct. 5, 2018.

(56) References Cited

OTHER PUBLICATIONS

Non-Final Office Action received in U.S. Appl. No. 13/666,427 dated Sep. 13, 2013 (12 pages).
Non-Final Office Action received in U.S. Appl. No. 13/927,231 dated Sep. 13, 2013 (19 pages).
Non-Final Office Action received in U.S. Appl. No. 14/267,699 dated Apr. 17, 2015, 18 pages.
Notice of Allowance received in U.S. Appl. No. 13/666,427 dated Feb. 19, 2014 (22 pages).
Office Action in DE Appl. 102015105383.7 dated Nov. 4, 2016 (no English translation; 4 pages).
Office Action received in Chinese Application No. 201410289785.9, dated Dec. 31, 2015, with English translation (23 pages).
Second Office Action issued in CN Appl. No. 201510179900.1 dated Aug. 9, 2017, with English translation (13 pages).
U.S. Office Action dated Jan. 21, 2016, from related U.S. Appl. No. 14/507,401.
U.S. Office Action on 104298-0394 dated Aug. 17, 2015.
U.S. Office Action on U.S. Appl. No. 14/844,160 dated May 13, 2016.
U.S. Office Action on U.S. Appl. No. 15/206,379 dated Feb. 28, 2017.
U.S. Office Action on U.S. Appl. No. 15/706,905 dated Feb. 14, 2018.
U.S. Office Action on U.S. Appl. No. 15/714,085 dated Mar. 29, 2018.

* cited by examiner

200

FLEXING POKE HOME CONTACT

CROSS-REFERENCE TO RELATED APPLICATIONS

This application claims the benefit of and priority to U.S. patent application Ser. No. 15/967,654, filed May 1, 2018, which claims priority to U.S. Provisional Application No. 62/513,655, filed Jun. 1, 2017, each of which is incorporated herein by reference in its entirety.

FIELD

The present application relates generally to the field of electrical connectors, and more particularly to a type of connector used to connect an electrical wire to an electrical component.

BACKGROUND

The following description is provided to assist the understanding of the reader. None of the information provided or references cited is admitted to be prior art.

Various types of connectors are used for forming connections between an insulated wire and any manner of electronic or electrical component. These connectors are typically available as sockets, plugs, and shrouded headers in a vast range of sizes, pitches, and plating options. Typically, a connector is electrically coupled to an electrical component that is designed to receive the connector. For example, an electrical component typically must be designed to have a female socket in order to receive a male contact tine. However when it is desirable to make an electrical connection between a flat conductive pad of an electrical component (e.g., a printed circuit board) and an electrical connector, the lack of mechanisms for mechanically securing the components presents new challenges. In other words, traditional connections in which a flat conductive pad and electrical connector are merely touching lack a sufficiently secure mechanical connection that is resilient to vibration, shock, and other forces that may cause the connection to fall apart. Furthermore, when a flat conductive pad is in a limited space, it is difficult to mechanically secure a wire to the flat conductive pad.

SUMMARY

The systems, methods and devices of this disclosure each have several innovative aspects, no single one of which is solely responsible for the desirable attributes disclosed herein.

An electrical contact includes a cage-like structure, a wire connecting portion, and a flexing contact portion. The cage-like structure includes a plurality of sidewalls that define a wire inlet at a proximal end of the electrical contact. The wire connecting portion includes a first contact tine that extends from a first sidewall of the cage-like structure and a second contact tine that extends from a second sidewall of the cage-like structure. The first and second contact tines create a pinch-point that can compress a conductive core of a corresponding wire.

The flexing contact portion includes an end wall, an elastic portion that extends from the end wall toward the proximal end, and an extension portion that extends from the elastic portion. The end wall is located as a distal end of the electrical contact. That is, the wall is connected to a base at an opposite end from the wire inlet. The flexing contact portion may also include a nose portion that extends from the distal end of the extension portion. In an embodiment, the nose portion is gold plated to increases its conductivity. The nose portion extends from the extension portion in a different direction than the extension portion extends from the elastic portion. In other words, the nose portion is rounded (e.g., bent downward toward the cage-like structure. In one embodiment, the extension portion includes a straight segment that extends between the elastic portion and the nose portion. In other words, the extension portion is not bent or curved as it extends from the elastic portion to the nose portion.

The elastic portion includes a curved portion between the end wall and the extension portion. Additionally, the elastic portion and the extension portion are cantilevered from the end wall (e.g., they are connected to the end wall at one side). Further, at least a portion of the extension portion is cantilevered over the wire connection portion. In an embodiment, the width of the end wall is greater than the width of the elastic and extension portion. This helps minimize interference from other objects when the electrical contact is being used. The cage-like structure, the wire connecting portion, and the contact portion may all be of a single conductive element. Alternatively, the cage-like structure, the wire connecting portion, and the contact portion may be separate elements that are mechanically and electrically coupled together. One of the pluralities of sidewalls includes a base that extends along the wire connecting portion and connects to the end wall. In other words, the base extends from the wire inlet at the proximal end to the flexing contact portion at the distal end. The end wall extends perpendicularly to the base at the distal end.

The electrical contact may be used in a system that includes a printed circuit board, an electrical component having a contact pad, and a wire. For example, a portion of the base of the electrical contact may be mounted to the printed circuit board or other rigid structure. In this system, the contact pad can be conductively coupled to the flexing contact portion, and the wire can be conductively coupled to the wire connection portion, thereby forming an electrically-conductive connection between the wire and the electrical component.

In an embodiment, to form such a connection, the wire is inserted into a wire inlet opening at the proximal end of the electrical contact. A conductive core of the wire is extended into the wire connecting portion of the electrical contact such that the conductive core of the wire is compressed between a first contact tine and a second contact tine of the electrical contact. The electrical contact is also positioned adjacent to the contact pad of the electrical component such that the flexing contact portion makes contact with the contact pad. As a result, the contact pad is conductively coupled the electrical contact and the wire. The flexing contact portion stores elastic energy due to distortion of the flexing contact portion while it is being positioned. The stored elastic energy supplies a force back on the contact pad. This configuration is beneficial at least in part because it helps ensure that the electrical contact and the electrical component stay conductively coupled during movement or shifting of either component. In one embodiment, the contact between the electrical contact and the electrical component is between the nose portion of the electrical contact and the contact pad of the electrical component.

DETAILED DESCRIPTION

Figure 1:
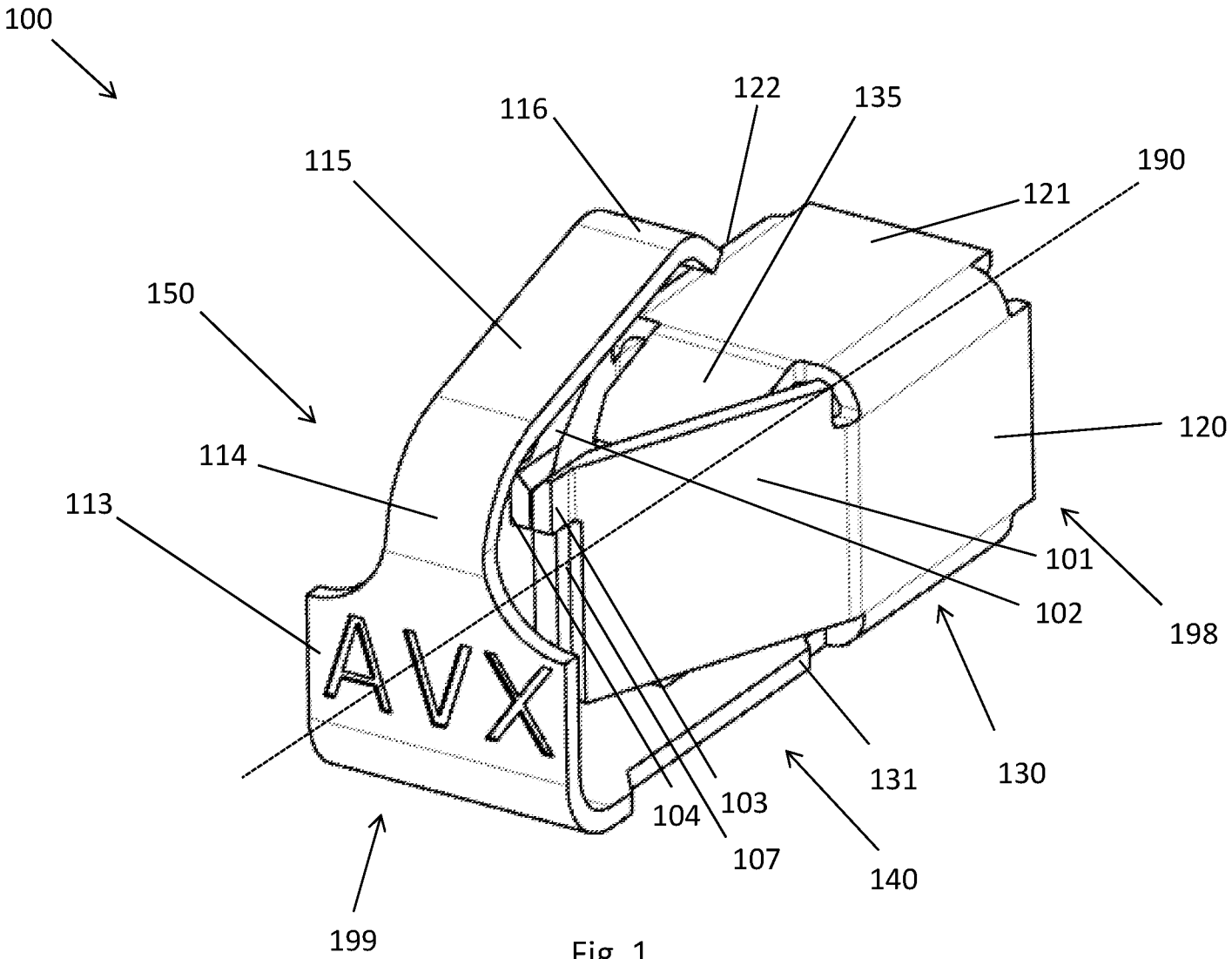
FIG. 1 depicts an isometric view of an electrical contact in accordance with an illustrative embodiment.

Reference will now be made to various embodiments, one or more examples of which are illustrated in the figures. The embodiments are provided by way of explanation of the invention, and are not meant as a limitation of the invention. For example, features illustrated or described as part of one embodiment may be used with another embodiment to yield still a further embodiment. It is intended that the present application encompass these and other modifications and variations as come within the scope and spirit of the invention.

Disclosed herein is an electrical contact with a flexing contact portion. Such electrical contacts are used to efficiently and reliably mechanically and electrically couple one or more wires to an electrical component (e.g., a printed circuit board). Specifically, the electrical contact allows for a quickly assembled connection between the conductive element of an electrical wire, the electrical contact, and the electrical component. Further, the flexing contact portion ensures that the electrical connection between the electrical contact and electrical component is secure and reliable. Specifically, the flexing contact portion is designed to allow the electrical contact to shift or move slightly relative to the electrical component without disrupting the electrical connection. More specifically, the flexing contact can be moved (e.g., bent downward) during connection of the electrical contact with the electrical component, which allows for greater design and spacing tolerances when manufacturing and assembling the electrical contact and electrical component. Moreover, the flexing contact creates a more reliable electrical connection to an electrical component because, when the electrical contact is properly connected to the electrical component, the flexing contact portion will exert a force onto the electrical component due to compression of the flexing contact portion. Additionally, the unique design of a nose portion on the flexing contact portion ensures that the electrical contact will not damage an electrical component even when forcibly removed from its connected position. Lastly, an electrical contact with a flexing contact portion allows a user to conductively couple a wire to a flat conductive pad that is located in a limited space. That is, a user can simply attach a wire to the electrical contact (outside of the limited space) and insert the electrical contact into the limited space such that the flexing contact portion conductively couples with the flat conductive pad.

Various embodiments of an electrical contact are illustrated throughout FIGS. 1 through 5 and described in additional detail below. The electrical contact is configured for connecting a conductive core of an electrical wire with an electrical component, such as a printed circuit board (PCB). In an embodiment, the electrical contacts may each connect to one, two, three, or more wires. Furthermore, the insulated housing may house one, two, or more electrical contacts. It should be appreciated that the electrical contact is not limited by a number of wire positions or types of connections that the electrical contact may make.

FIG. 1 depicts an isometric view of an electrical contact 100 in accordance with an illustrative embodiment. The electrical contact 100 includes a cage-like structure 130, a wire connecting portion 140, and a flexing contact portion 150. The cage-like structure 130 has a plurality of sidewalls. The plurality of sidewalls define a wire inlet at a proximal end 198 of the electrical contact.

For ease of explanation, the plurality of sidewalls of the cage-like structure 130 are depicted to include a base 131, a first sidewall 120, a second sidewall 122, and an upper surface 121. The base 131 extends from the cage-like structure 130 and connects the cage-like structure 130, the wire connecting portion 140, and the flexing contact portion 150. FIG. 1 depicts the cage-like structure 130 as having a square-shaped perimeter. In other embodiments, the cage-like structure 130 may have any of a variety of perimeter shapes and may include more or fewer surfaces. For example, the cage-like structure 130 may include three, four, five, or more surfaces and may have a rectangular, triangular, or other perimeter shapes as may be desired for specific applications. In the embodiment of FIG. 1, the cage-like structure 130 consists of a single conductive element. In alternative embodiments, the cage-likes structure 130 may be made from multiple elements that are mechanically and/or electrically coupled together.

The wire connecting portion 140 includes the base 131, a first contact tine 101, a second contact tine 102, an upper wire guide 135, and a lower wire guide (not shown in FIG. 1). Base 131 is shared by the wire connecting portion 140 and the cage-like structure 130 such that the wire connecting portion 140 is mechanically and electrically coupled to the cage-like structure 130 by the base 131. The first contact tine 101 extends from a distal end of the first sidewall 120 (i.e., toward a distal end 199 of the electrical contact 100) and also extends inward from the first sidewall 120 toward a centerline axis 190. The second contact tine 102 extends from a distal end of the second sidewall 122 (i.e., toward the distal end 199 of the electrical contact 100) and also extends inward from the second sidewall 122 toward the centerline axis 190. The first contact tine 101 and the second contact tine 102 create a pinch-point 107 where the first and second contact tines 101, 102 can compress the conductive core of a corresponding inserted wire to mechanically and electrically couple the electrical contact 100 to the corresponding wire. Furthermore, the first contact tine 101 and the second contact tine 102 include release tabs 103 and 104, respectively. The release tabs 103 and 104 extend in a parallel direction to the centerline axis 190 from their respective contact tines 101 and 102. The release tabs 103 and 104 provide a location for insertion of a tool between the first contact tine 101 and the second contact tine 102 for removal of a wire.

Figure 2:
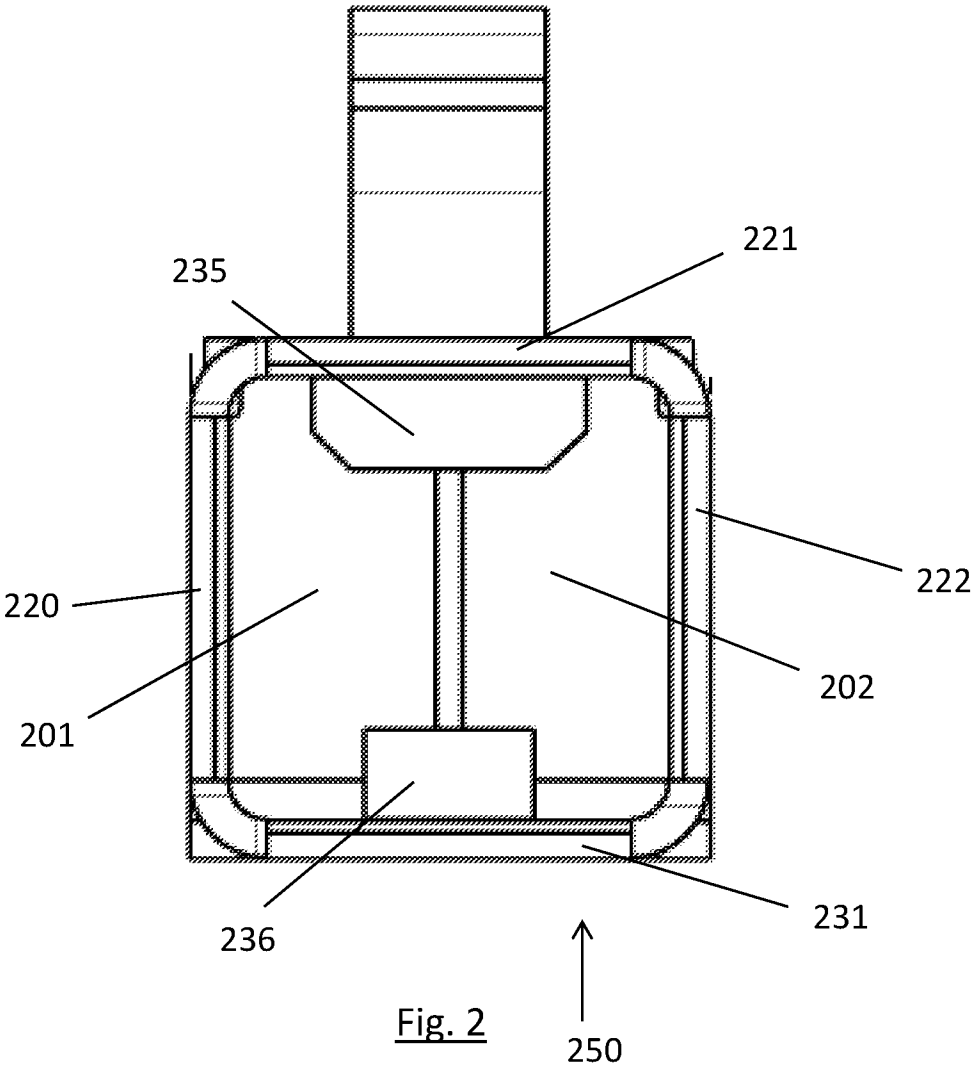
FIG. 2 depicts an end view of an electrical contact in accordance with an illustrative embodiment.

The upper wire guide 135 extends from the upper surface 121 of the cage-like structure 130 in the same direction that the base 131 and contact tines 101 and 102 extend (i.e., from a sidewall of the cage-like structure 130 toward the distal end of the electrical contact 100). Additionally, as the upper wire guide 135 extends from the upper surface 121 it also extends towards the centerline axis 190. The upper wire guide 135 ensures that the conductive core of a corresponding wire is guided towards the pinch-point 107 of the first and second contact tines 101 and 102. Further, the upper wire guide 135 may also be another mechanical and electrical contact point between the electrical contact 100 and the corresponding wire. A lower wire guide (not depicted)

may also extend from a lower portion (i.e., the base 131) of the cage-like structure, as shown in FIG. 2.

The flexing contact portion 150 is connected to the base 131 and includes an end wall 113, an elastic portion 114, an extension portion 115, and a nose portion 116. The end wall 113 is connected to the base 131 at a distal end 199 of the electrical contact 100. The end wall 113 is depicted as a bent-up portion of the base 131. In alternative embodiments, the end wall 113 may be a different element than the base 131. In FIG. 1, the end wall 113 extends from the base 131 in a direction perpendicular to the primary direction along which the base 131 extends. The end wall 113 may extend from the base at a ninety degree angle (as depicted), or it may extend an angle greater than or less than ninety degrees.

The elastic portion 114 extends from the end wall 113 and is connected to the extension portion 115. In an embodiment, the elastic portion 114 has a width that is less than the width of the base 131 and the end wall 113 to permit greater relative flexibility of the elastic portion 114 relative to the base 131 and end wall 113. The elastic portion 114 allows for the extension portion 115 and nose portion 116 to be flexible in terms of the angle that they extend relative to the end wall 113 and the base 131. That is, the elastic portion 114 allows for the extension portion 115 to extend along a plane parallel to the base 131 (i.e., ninety degrees relative to the end wall 113) when a force is applied to the extension portion 115 or nose portion 116. Alternatively, the elastic portion 114 relaxes when the force is not applied to the extension portion 115 or nose portion 116 and causes the extension portion 115 to extend in a non-parallel direction to the base (i.e., a neutral position that has less than a ninety degree bend relative to the end wall 131). FIG. 1 depicts the flexing contact portion 150 in its neutral position.

The elastic portion 114 stores elastic energy that allows for the extension portion 115 and nose portion 116 to forcibly make contact with a corresponding device when the elastic portion 114 is distorted from its neutral position. For example, when the electrical contact 100 is inserted into a corresponding receptacle, the elastic portion 114 ensures that the extension portion 115 and nose portion 116 form a mechanical and electrical connection to a corresponding conductive pad or other conductive area of an electrical component. When an adjacent component forces the flexing contact portion 150 from its neutral position, the elastic portion 114 stores elastic energy and exerts a force back toward the adjacent component (and toward its neutral position). The force applied by the elastic portion 114 ensures that the electrical contact 100 is actively creating a frictional force to mechanically secure the electrical contact 100 in its desired positioning. Without the flexing contact portion 114, the electrical contact 100 would need to have much smaller tolerances so as to form a much closer fit and connection to a corresponding device than that required with electrical contact 100. Thus, the flexing contact portion 114 increases the versatility and reliability of the electrical contact 100 when compared to traditional contacts.

As stated above, the extension portion 115 extends from its proximal end at the elastic portion 114 to its distal end furthest away from the elastic portion. The distal end of the extension portion 115 is further connected to the nose portion 116. The nose portion 116 may be gold plated on one or more sides. The gold plating helps ensure that an electrical connection is created between the nose portion 116 and a conductive element of a corresponding electrical device. The length that the extension portion 115 extends from the elastic portion 114 will depend on the application and design of electrical contact 100 and/or the corresponding electrical device to which the electrical contact 100 is to be connected.

Additionally, the nose portion 116 extends from the extension portion 115 at a non-parallel angle (e.g., downward) to ensure that the electrical contact 100 does not damage corresponding devices when it is removed from that corresponding device. That is, bending the nose portion 116 downward (i.e., toward the base 131 ensures that an edge of the nose portion 116 or extension portion 115 cannot accidentally grab a corresponding device (e.g., a portion of a PCB board) and damage the corresponding device.

As depicted in FIG. 1, the electrical contact 100 is formed out of a single conductive element. In alternative embodiments, each portion or element may comprise a discrete component that is welded, soldered, or otherwise mechanically and electrically coupled to other discrete components to form the electrical contact 100.

FIG. 2 depicts an end view of an electrical contact 200 in accordance with an illustrative embodiment. More specifically, FIG. 2 depicts the end of the electrical contact 200 corresponding to the proximal end 198 of electrical contact 100 from FIG. 1. The electrical contact 200 includes a wire inlet 250 that is defined by the cage-like structure. That is, the wire inlet 250 is defined by a first sidewall 220, a second sidewall 222, a base 231, and an upper surface 221. A first contact tine 201 extends from the first sidewall 220 and toward a centerline axis extending from the proximal end of the electrical contact 200 to its distal end. A second contact tine 202 extends from the second sidewall and toward the centerline axis. An upper wire guide 235 extends from the upper surface toward the centerline axis. Further, a lower wire guide 236 extends from the base 231 toward the centerline axis. The lower wire guide 236 is depicted as a portion of the base 231 bent toward the upper surface 221. In an embodiment, the lower wire guide 236 begins to extend toward the centerline axis at the same distance from the proximal end that the first contact tine 201 begins to extend from the first sidewall 220. The first contact tine 201, the second contact tine 202, the upper wire guide 235, and the lower wire guide 236 help ensure that a corresponding wire can be easily inserted and mechanically and electrically coupled to the electrical contact 200. For example, the first and second contact tines 201 and 202 are positioned such that a conductive core of a wire may be inserted and compressed between the contact tines to form an electrical connection. Furthermore, the upper and lower wire guides 235 and 236 guide the wire between the first and second contact tines 201 and 202.

Figures 3A, 3B, 3C:
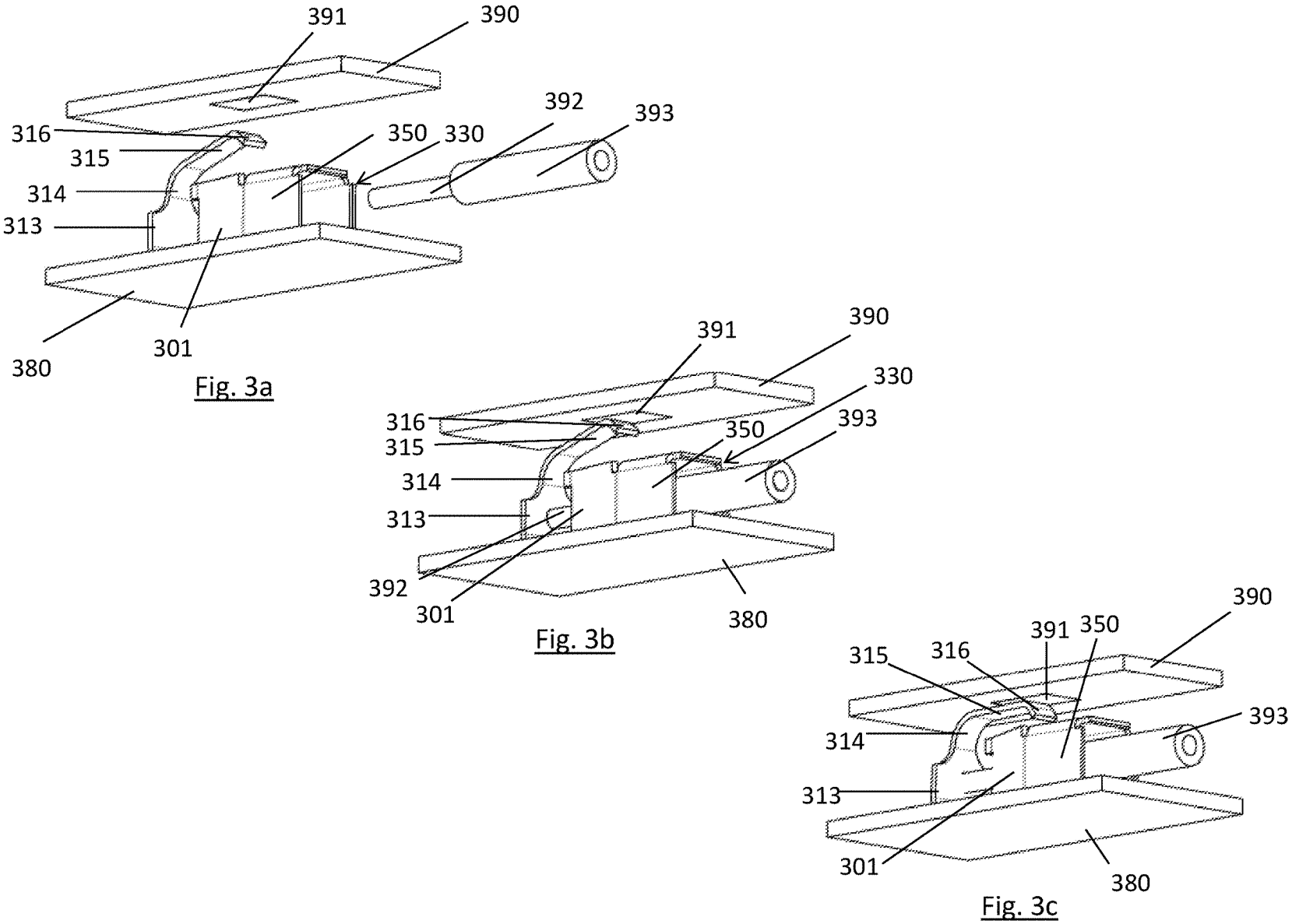
FIGS. 3*a*-3*c* depict isometric views of an electrical contact, a printed circuit board, a wire, and an electrical component during various stages of assembly in accordance with an illustrative embodiment.

FIGS. 3*a*-3*c* depict various isometric views of an electrical contact 350, a printed circuit board 380, a wire 393, and an electrical component 390 during various stages of assembly in accordance with an illustrative embodiment. In each of FIGS. 3*a*-3*c*, the electrical contact 350 is mounted to the printed circuit board 380. The electrical contact 350 may be mounted to an insulated portion of the printed circuit board 380 in one embodiment. For example, the electrical contact 350 may be affixed to an insulated portion of the printed circuit board 380 such that there is no conductive coupling between a conductive portion of the printed circuit board 380 and the electrical contact 350. In another embodiment, the electrical contact 350 may be mounted to an electrically-conductive contact pad of the printed circuit board 380. For example, the electrical contact 350 may be conductively coupled to the printed circuit board 380 via soldering or welding of the electrical contact 350 to a conductive portion of the printed circuit board 380.

The electrical contact 350 includes an end wall 313, an elastic portion 314, an extension portion 315, a nose portion 316, a first contact tine 301, a second contact tine (not depicted), and a cage-like structure 330. The electrical component 390 includes a contact pad 391 that may be connected to additional electronic circuitry.

FIG. 3*a* depicts an isometric view of the electrical contact 350 mounted to a printed circuit board 380, a wire 393, and the electrical component 390 prior to connection of the electrical contact 350, the wire 393, and the electrical component 390 in accordance with an illustrative embodiment. As depicted in FIG. 3*a*, neither the wire 393, the electrical contact 350, or the electrical component 390 are electrically or mechanically coupled. The flexing contact portion (including the elastic portion 314, the extension portion 315, and the nose portion 316) of the electrical contact 350 is in a neutral, unbiased position.

FIG. 3*b* depicts an isometric view of the electrical contact 350 mounted to a printed circuit board 380, and a wire 393 conductively coupled to an electrical component 390 via the electrical contact in accordance with an illustrative embodiment. FIG. 3*b* depicts the wire 393 inserted into the cage-like structure 330 of the electrical contact 350. The first contact tine 301 and the second contact tine (not depicted) compress a conductive core 392 of the wire 393 and mechanically and electrically couple the wire 393 to the electrical contact 350. The end wall 313 of the electrical contact 350 may also be in mechanical and electrical contact with the conductive core 392 of the wire 393. Furthermore, the nose portion 316 has been brought into physical contact with the contact pad 391 of the electrical component 390. While the electrical contact 350 is in physical contact with the contact pad 391, the electrical contact 350 is still in its neutral position (i.e., the elastic portion 314 is not being compressed or distorted).

FIG. 3*c* depicts a third isometric view of the electrical contact 350 mounted to the printed circuit board 380, and the wire 393 conductively coupled to an electrical component 390 via the electrical contact 350 in accordance with an illustrative embodiment. A distance between the printed circuit board 380 and the electrical component 390 has been decreased (relative to the distance there between depicted I FIG. 3*b*), thereby compressing a flexing contact portion of the electrical contact 350 and causing distortion of the elastic portion 314 of electrical contact 350. As such, the flexing contact portion of the electrical contact 350 is forced out of its neutral position to an active position. That is, the nose portion 316 and the extension portion 315 are pushed toward the printed circuit board 380 due to physical contact with the electrical component 390. Stored elastic energy in the flexing portion 314 causes the nose portion 316 and/or the extension portion 115 to apply a force on the contact pad 391 of the electrical component 390, resulting in a mechanical and electrical connection between the contact pad 391 and the electrical contact 350. Due to the flexing nature of the flexing contact portion of electrical contact 350, the mechanical and electrical connection between the contact pad 391 and the electrical contact 350 may be sustained even in the event of shocks or vibrations sustained by the electrical component 390, the printed circuit board 380, or the electrical contact 350 or if varying forces are applied between the printed circuit board 380 and the electrical component 390. Thus, a more robust and reliable electrical connection is created between the electrical contact 350 and the electrical component 390. Additionally, since the nose portion 316 is rounded down (i.e., bent down towards the cage-like structure) the electrical contact 350 can be pulled away (i.e., pulled in the direction of the wire) without damaging the contact pad 391 or the electrical component 390.

Figure 4B:
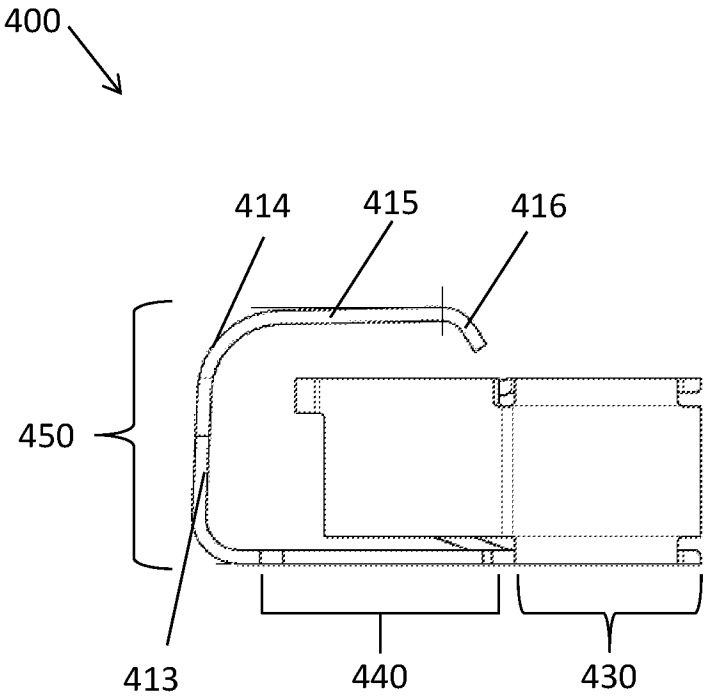
FIGS. 4*a* and 4*b* depict a side view of an electrical contact in accordance with an illustrative embodiment.
Figure 4A:
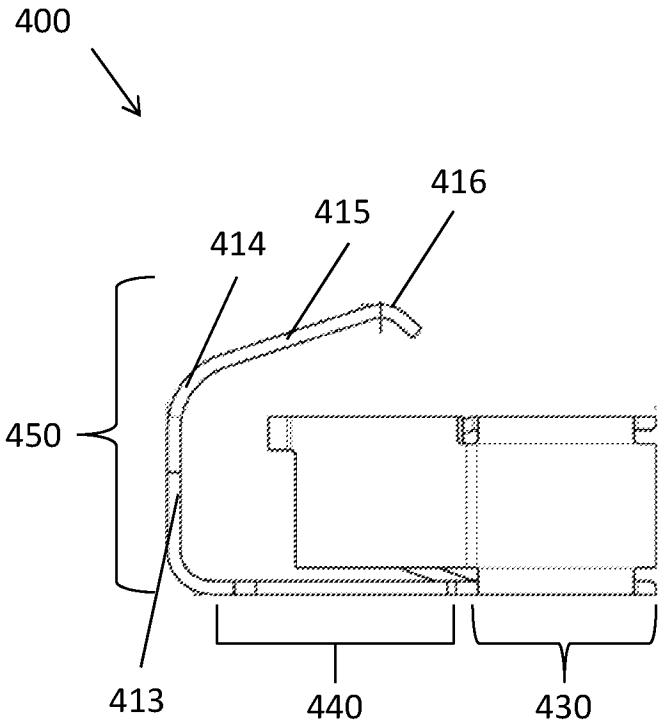

FIGS. 4*a* and 4*b* depict side views of an electrical contact 400 in accordance with an illustrative embodiment. The electrical contact 400 includes a cage-like structure 430, a wire connecting portion 440, and a flexing contact portion 450. The flexing contact portion 450 includes an end wall 413, an elastic portion 414, an extension portion 415, and a nose portion 416. FIG. 4*a* depicts the flexing contact portion 450 in a neutral position, and FIG. 4*b* depicts the flexing contact portion 450 in an active (or compressed) position. That is, in FIG. 4*a* there is no force being applied to the flexing contact portion 450 and it is in a neutral (i.e., relaxed) position (i.e., there is no stored energy or force being exerted). In FIG. 4*b*, an external force by an external object has caused the extension portion 415, nose portion 416, and part of the elastic portion 414 to be compressed toward the wire connecting portion 440. The compression causes elastic energy to be stored in the elastic portion 414 due to the elastic portion 414 being distorted from its neutral position. The storage of the elastic energy in the elastic portion 414 causes the flexing contact portion 450 to apply a force back toward the external object because the flexing contact portion 450 is attempting to return to its neutral position.

Figure 5:
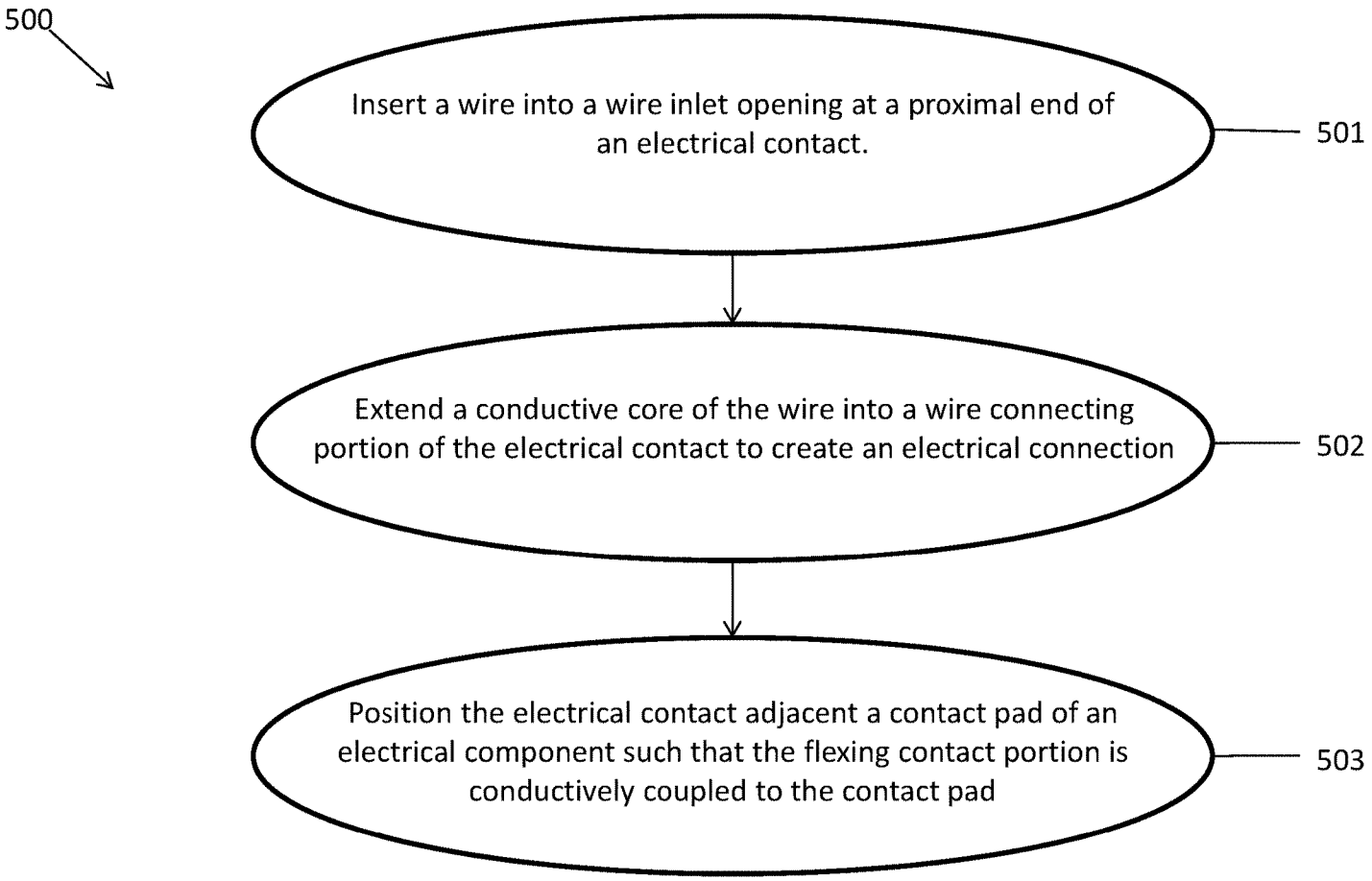
FIG. 5 depicts a flow diagram for a method of using an electrical contact in accordance with an illustrative embodiment.

FIG. 5 depicts a flow diagram for a method 500 of using an electrical contact in accordance with an illustrative embodiment. In an operation 501, an electrical wire is inserted into a cage-like structure of an electrical contact. The wire is inserted into a wire inlet of the cage-like structure. An end of the electrical wire may be stripped prior to insertion of the electrical wire into the cage-like structure. In an embodiment, the cage-like structure is large enough to house the insulated portion of the electrical wire. In alternative embodiments, the cage-like structure is sized to only house the conductive core of the electrical wire.

In an operation 502, a conductive core of the electrical wire is extended into a connection portion of the electrical contact such that the conductive core is compressed between two contact tines of the electrical contact and an electrical and mechanical connection is created there between. The electrical contact may include an upper wire guide and a lower wire guide that assist in positioning the conductive core of the electrical wire between the two contact tines during insertion of the electrical wire into the electrical contact. For example, the upper wire guide may help ensure that the conductive core of the wire does not travel above the pinch-point, and the lower wire guide may help ensure that the conductive core of the wire does not travel below the pinch-point.

In an operation 503, the electrical contact is positioned adjacent to a contact pad of an electrical component such that a force is applied between the contact pad and a flexing contact portion of the electrical contact. As a result, the flexing contact portion of the electrical contact stores elastic energy and applies a counteractive force toward the contact pad via a point of contact between the flexing contact portion of the electrical contact and the contact pad of the electrical component. The point of contact between the contact pad and electrical contact may be made via an extension portion and/or a nose portion of the flexing contact portion of the electrical contact. The electrical contact may be further mounted on a printed circuit board, wiring board, electrical device, or other structure before or after being positioned adjacent to the contact pad. In one embodiment, the electrical contact may be soldered, welded or otherwise conductively coupled to a contact pad of the device of which it is mounted. In alternative embodiments, the electrical contact may simply be affixed to an insulated portion of a device (e.g., a board or housing). The positioning of the electrical contact and corresponding electrical component may be done by compressing the electrical contact into a receptacle, where the contact pad of the electrical component is located within the receptacle.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. An electrical contact comprising:

a wire inlet portion;

a wire connecting portion connected to the wire inlet portion, the wire connecting portion comprising a first contact tine and a second contact tine that define a pinch-point; and a flexing contact portion connected to the wire connecting portion, the flexing contact portion comprising:

an end wall;

an elastic portion extending from the end wall toward the wire inlet portion; and an extension portion extending from the elastic portion.

2. The electrical contact of claim 1, wherein the flexing contact portion further comprises a nose portion extending from the extension portion.

3. The electrical contact of claim 2, wherein the nose portion is gold-plated.

4. The electrical contact of claim 2, wherein the nose portion extends from an end of the extension portion at a different direction than a direction at which the extension portion extends from the elastic portion.

5. The electrical contact of claim 2, wherein the nose portion extends from the extension portion toward the wire connecting portion.

6. The electrical contact of claim 2, wherein the extension portion comprises a straight segment extending between the elastic portion and the nose portion.

7. The electrical contact of claim 1, wherein the elastic portion comprises a curved portion between the end wall and the extension portion.

8. The electrical contact of claim 1, wherein the elastic portion and the extension portion are cantilevered from the end wall.

9. The electrical contact of claim 8, wherein at least a portion of the extension portion extends over the wire connecting portion.

10. The electrical contact of claim 1, wherein a width of the end wall is greater than a width of the extension portion.

11. The electrical contact of claim 1, wherein the electrical contact consists of a single conductive element.

12. The electrical contact of claim 1, further comprising a base portion shared by the wire inlet portion and the wire connecting portion.

13. The electrical contact of claim 12, wherein the wire inlet portion comprises a plurality of sidewalls, and wherein the base portion comprises at least one sidewall of the plurality of sidewalls.

14. The electrical contact of claim 13, wherein the base portion connects to the end wall of the flexing contact portion.

15. The electrical contact of claim 12, wherein the end wall is perpendicular to the base portion.

16. The electrical contact of claim 1, wherein the wire inlet portion is located at a first end of the electrical contact, wherein the end wall is located at a second end of the electrical contact, and wherein the elastic portion extends from the second end toward the first end.

17. The electrical contact of claim 1, wherein the wire inlet portion comprises a first sidewall and a second sidewall, wherein the first contact tine extends from the first sidewall, and wherein the second contact tine extends from the second sidewall.

18. A system comprising:

an electrical contact comprising:

a wire inlet portion;

a wire connecting portion comprising:

a first contact tine extending from the wire inlet portion; and a second contact tine extending from the wire inlet portion to define a pinch-point between the first contact tine and the second contact tine; and a flexing contact portion connected to the wire connecting portion, wherein the flexing contact portion comprises an extension portion that is cantilevered over at least a portion of the wire connecting portion;

a printed circuit board connected to the electrical contact; and an electrical component comprising a contact pad, wherein the flexing contact portion is conductively coupled to the contact pad.

19. The system of claim 18, wherein the flexing contact portion further comprises:

an end wall;

an elastic portion extending from the end wall; and a nose portion extending from the extension portion, wherein the extension portion extends from the elastic portion and creates a force compressing the nose portion against the contact pad.

20. The system of claim 18, further comprising a wire positioned within the wire inlet portion, wherein the wire includes a conductive core that is electrically coupled to the first contact tine and the second contact tine.

* * * * *